US009782021B2

(12) United States Patent
Shaffer

(10) Patent No.: US 9,782,021 B2
(45) Date of Patent: Oct. 10, 2017

(54) ADJUSTABLE END CAP DISPLAY

(71) Applicant: WestRock Shared Services, LLC, Norcross, GA (US)

(72) Inventor: Douglas Shaffer, Winston Salem, NC (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 15/016,814

(22) Filed: Feb. 5, 2016

(65) Prior Publication Data

US 2016/0198869 A1 Jul. 14, 2016

Related U.S. Application Data

(63) Continuation of application No. 14/990,877, filed on Jan. 8, 2016.

(60) Provisional application No. 62/101,475, filed on Jan. 9, 2015.

(51) Int. Cl.
*A47B 43/00* (2006.01)
*A47F 5/10* (2006.01)
*A47F 5/11* (2006.01)

(52) U.S. Cl.
CPC ..... *A47F 5/10* (2013.01); *A47F 5/112* (2013.01); *A47B 43/00* (2013.01)

(58) Field of Classification Search
CPC ..... A47B 47/06; A47B 43/00; A47F 5/11
USPC ..... 108/99, 162, 166; 312/255, 262; 211/135, 149, 195, 189, 175
See application file for complete search history.

(56) References Cited

U.S. PATENT DOCUMENTS 1,875,460 A * 9/1932 Holy ..... A47F 5/112 248/450
1,897,940 A * 2/1933 Leopold ..... A47F 5/112 248/174
2,002,246 A * 5/1935 Miller ..... B65D 5/16 229/122
2,150,743 A * 3/1939 Mancuso ..... G09F 5/00 211/135

(Continued)

FOREIGN PATENT DOCUMENTS

DE 4311045 1/1994
FR 2799624 4/2001

(Continued)

OTHER PUBLICATIONS

European Search Report for EP counterpart application, May 24, 2016.

*Primary Examiner* — Joshua J Michener
*Assistant Examiner* — Devin Barnett
(74) *Attorney, Agent, or Firm* — WestRock IP Legal

(57) ABSTRACT

An adjustable end cap display that is configured to be used in a variety of retail environments. Specifically, the width of the disclosed end cap display is adjustable, which allows a single end cap display to be used in retail environments having different size requirements and space constraints. In one non-limiting embodiment, the rear of the end cap display includes a plurality of series of slots or other apertures that, in conjunction with tabs of side wings of the display, determine the width of the assembled display. The width of the assembled display can be adjusted depending on which slots or apertures of the series of slots or apertures are selected.

18 Claims, 10 Drawing Sheets

(56) References Cited

U.S. PATENT DOCUMENTS 2,188,602 A * 1/1940 Hall ..... A47B 19/08 211/135
2,918,178 A * 12/1959 Leone ..... A47F 5/116 211/195
3,987,737 A * 10/1976 Smith ..... A47F 5/116 108/179
4,311,100 A * 1/1982 Gardner ..... A47F 5/116 108/165
4,493,424 A * 1/1985 Smith ..... A47F 5/116 108/165
4,506,790 A * 3/1985 Muscari ..... A47F 5/116 108/180
4,527,694 A * 7/1985 Bolt ..... B42F 15/0094 211/162
4,561,706 A * 12/1985 Grati ..... A47B 43/02 108/51.3
4,570,805 A 2/1986 Smith
4,655,352 A 4/1987 Noyes et al.
RE32,668 E * 5/1988 Smith ..... A47F 5/116 211/132.1
4,809,847 A * 3/1989 Schneider ..... B65D 5/16 206/45.28
5,315,936 A * 5/1994 Smith ..... A47F 5/116 108/165
5,458,411 A * 10/1995 Moss ..... A47F 5/116 312/259
5,630,518 A 5/1997 Collins
5,632,390 A * 5/1997 Podergois ..... A47F 5/116 211/149
5,669,683 A * 9/1997 Moss ..... A47F 5/116 312/259
5,826,732 A * 10/1998 Ragsdale ..... A47F 5/116 108/165
5,899,345 A * 5/1999 Fuller ..... A47F 5/116 211/126.16
6,068,140 A * 5/2000 Mangrum ..... A47F 5/116 108/107
6,126,254 A * 10/2000 Maglione ..... A47F 5/116 248/174
6,145,794 A * 11/2000 Smith ..... A47F 5/108 211/132.1
6,382,433 B1 * 5/2002 Podergois ..... A47F 5/10 211/195
6,454,106 B1 * 9/2002 Howard ..... A47B 45/00 211/43
6,464,092 B1 * 10/2002 Kortman ..... A47B 46/00 211/162
6,715,623 B2 * 4/2004 Broerman ..... A47F 5/116 211/149
7,007,615 B2 * 3/2006 Grueneberg ..... A47F 5/116 108/165
7,131,543 B2 * 11/2006 Mason ..... A47F 5/0018 211/135
7,374,047 B2 * 5/2008 Bryson ..... A47F 5/116 108/107
7,520,071 B2 4/2009 Abramson
D599,130 S * 9/2009 Clark ..... D6/301
7,677,433 B2 3/2010 Little
7,703,864 B2 * 4/2010 Moser ..... B65D 5/5213 206/747
7,757,418 B1 * 7/2010 Clark ..... A47F 5/112 40/605
7,954,655 B2 * 6/2011 Virvo ..... A47F 5/0043 211/149
8,136,677 B2 * 3/2012 Brozak ..... A47F 7/147 211/50
8,485,370 B2 * 7/2013 Dewhurst ..... A47F 5/116 211/135
8,540,091 B2 * 9/2013 Kristensen ..... A47F 5/10 211/135
8,857,633 B2 10/2014 Dewhurst
8,863,417 B2 10/2014 Gerstner
8,875,908 B2 11/2014 L'Hotel
8,955,243 B2 * 2/2015 Dashe ..... G09F 1/06 40/124.09
D787,599 S * 5/2017 Dashe ..... D20/40
2002/0108541 A1 * 8/2002 Grueneberg ..... A47F 5/116 108/115
2003/0209507 A1 * 11/2003 Dye ..... A47F 5/116 211/149
2004/0148825 A1 * 8/2004 Myers ..... A47F 5/116 40/124
2008/0000858 A1 * 1/2008 Fenerty ..... A47F 5/116 211/90.01
2008/0265726 A1 * 10/2008 Sheffer ..... A47B 47/06 312/259
2010/0006527 A1 * 1/2010 Kalwat ..... A47F 5/116 211/135
2010/0006529 A1 * 1/2010 Groff ..... A47F 5/116 211/186
2010/0051568 A1 * 3/2010 Kalwat ..... A47F 5/116 211/135
2010/0219232 A1 * 9/2010 Smith ..... B31B 1/36 229/108
2011/0192814 A1 * 8/2011 Chen ..... A47B 43/02 211/135
2013/0098909 A1 * 4/2013 Sitton ..... A47F 5/118 220/4.28
2013/0213915 A1 * 8/2013 Pfeifer ..... A47F 5/11 211/135
2014/0217047 A1 * 8/2014 Frost ..... B65H 45/12 211/135
2015/0136720 A1 * 5/2015 Miller ..... A47F 5/112 211/135
2015/0144686 A1 * 5/2015 Miranda ..... B65D 5/0005 229/101
2016/0066711 A1 * 3/2016 Mestres Armengol . A47F 5/116 211/135
2016/0082996 A1 * 3/2016 Jackson ..... B62B 3/025 280/33.996

FOREIGN PATENT DOCUMENTS

FR 2934948 2/2010
FR 2957502 9/2011
WO WO2007103936 11/2007
WO WO2008124452 10/2008

* cited by examiner

ADJUSTABLE END CAP DISPLAY

This application is a continuation of U.S. application Ser. No. 14/990,877, filed Jan. 8, 2016, which claims the benefit of priority under 35 U.S.C. §119(e) of U.S. provisional application Ser. No. 62/101,475 filed on Jan. 9, 2015, both of which applications are hereby incorporated by reference in their entireties.

TECHNICAL FIELD

The present disclosure generally relates to end cap displays commonly used in retail environments.

BACKGROUND

End cap displays are commonly used in retail environments to display and market various types of product. These end cap displays are sometimes positioned at the end of an aisle in a retail establishment. In this way, the dimensions of the end cap display are dictated by the dimensions and configuration of the end of the aisle with which the end cap display will be used. Therefore, different sized end cap displays are required for shelves or end caps having different dimensions.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Aspects of the present disclosure relate to an adjustable end cap display that is configured to be used in a variety of retail environments. Specifically, the width of the end cap display is adjustable, which allows a single end cap display to be used in retail environments having different size requirements and space constraints. In one non-limiting embodiment, the rear of the end cap display includes a series of slots or other apertures or mechanisms that determine the width of the assembled display. In particular, each series of slots is configured to receive tabs or other mechanisms of the side wings of the end cap display to lock the display into a display position. The width of the assembled display can be adjusted depending on which slots or other apertures of the series of slots are selected.

BRIEF DESCRIPTION OF THE DRAWINGS

Illustrative embodiments of the present disclosure are described in detail below with reference to the following drawing figures.

DETAILED DESCRIPTION

Certain aspects and features of the present disclosure relate to a display for an end cap, which refers to the end of an aisle where product is displayed in a retail environment. In particular, the disclosed end cap display is configured so that its width is adjustable so that the display can be used with end caps of different sizes and thus in many different retail environments.

Figure 1:
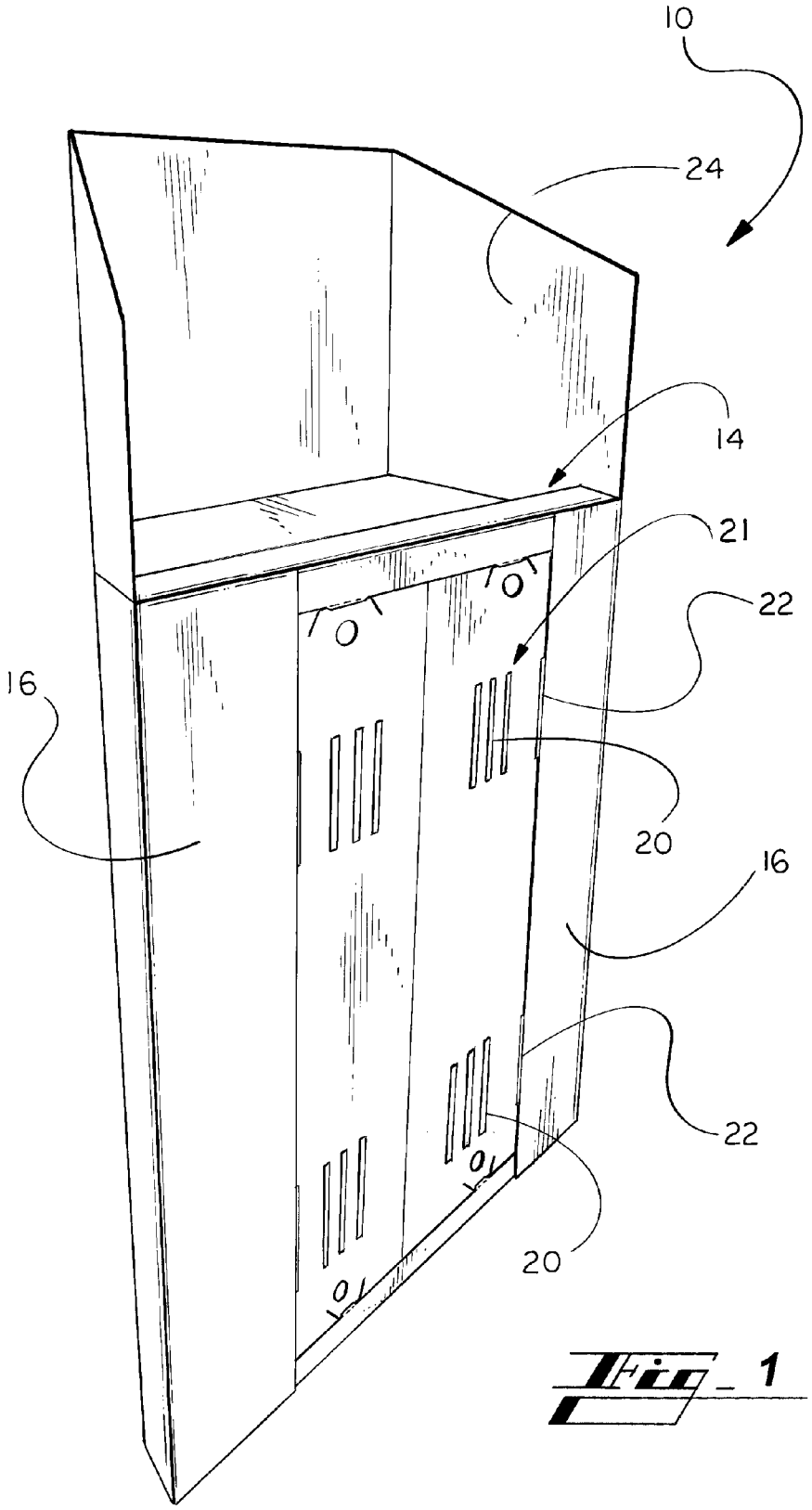
FIG. 1 is a rear perspective view of an end cap display, shown in a display position, according to one embodiment.
Figure 2:
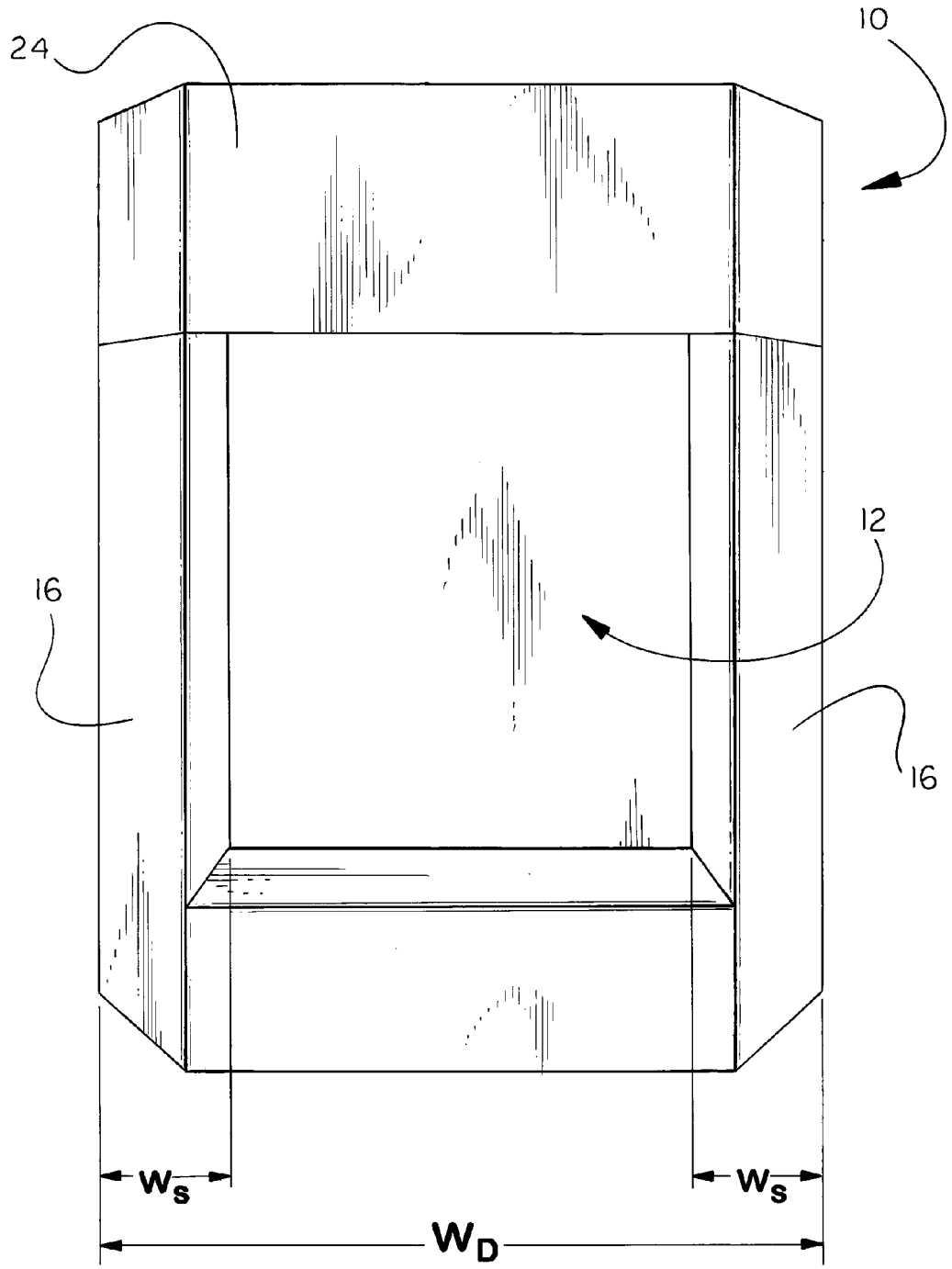
FIG. 2 is a front perspective view of an end cap display, shown in the display position, according to another embodiment.
Figure 11:
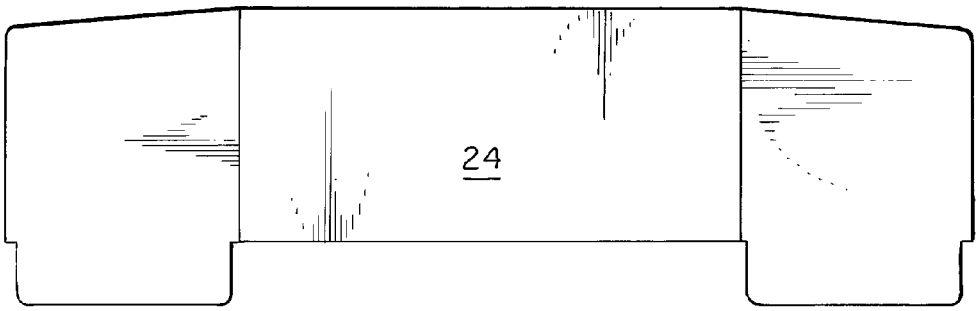
FIG. 11 is a blank from which the riser of the display of FIG. 2 is erected.
Figure 12:
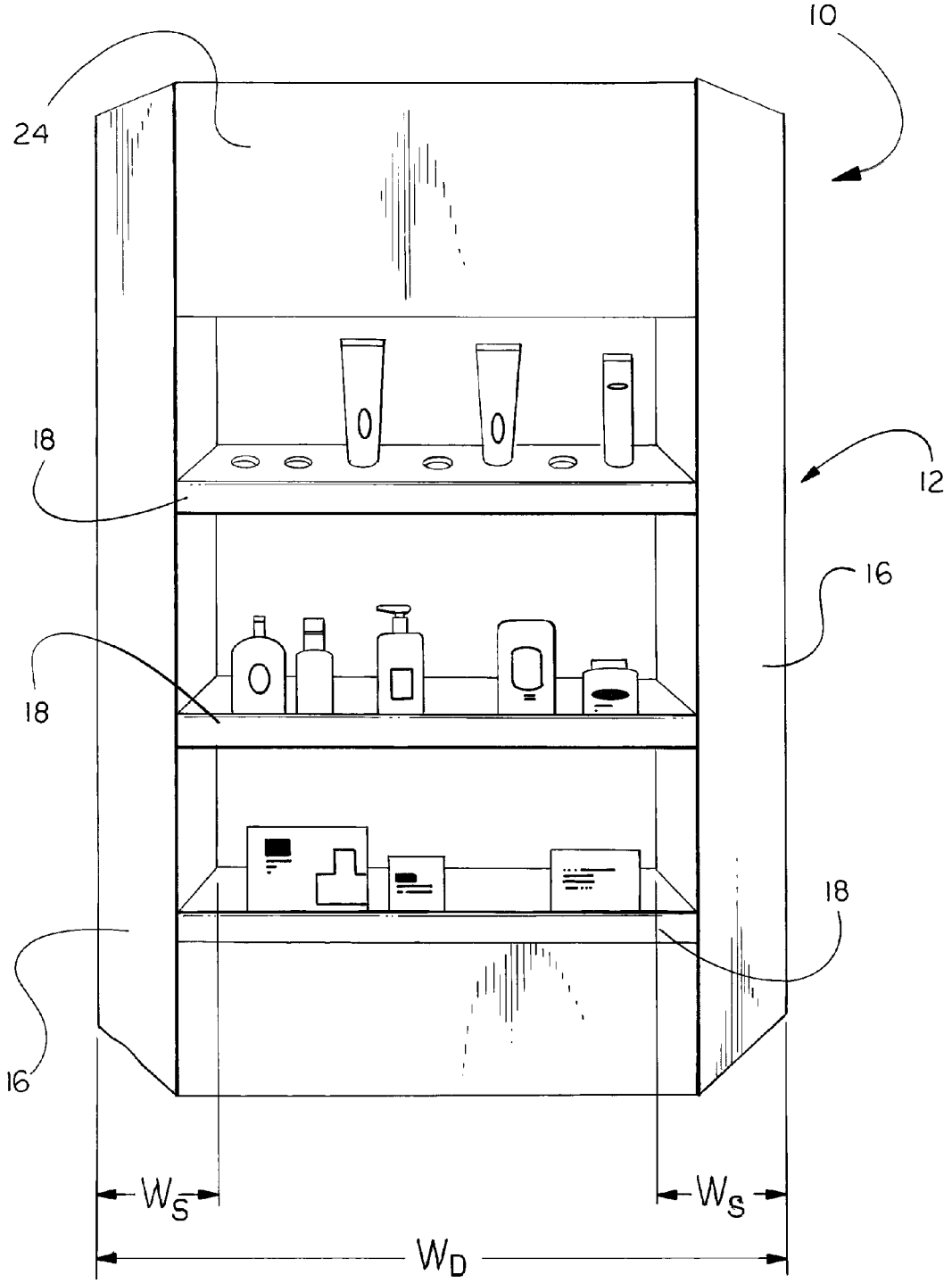
FIG. 12 is a front perspective view of the end cap display of FIG. 1, shown in the display position.

FIG. 1 illustrates a rear view of an embodiment of an end cap display 10 in the display position and FIG. 2 illustrates a front view of another embodiment of an end cap display 10 in the display position. As shown in the Figures, end cap display 10 includes a front 12 and a rear 14. FIGS. 7-11 illustrate sample blanks used to form one embodiment of end cap display, although other blanks may be used if desired. For example, in the illustrated embodiment, a rear panel (FIG. 7) is assembled with a base (FIG. 8), two side wings (FIGS. 9-10) and a riser (FIG. 11). However, display 10 need not be formed from separate pieces. End cap display 10 also includes two side wings 16 that extend from the rear 14. Each of the side wings 16 includes one or more tabs 22. When the display 10 is in the display position, the side wings 16 are rotated about fold lines 26 and 28 (FIGS. 4-5) toward rear 14. Each of the tabs 22 is configured to be received within a slot 20 of the rear 14 of the display when the display is in the display position. Slots 20 are described in more detail below and are not limited to the particular configuration shown. In some embodiments, as shown in FIG. 12, the product area of front 12 of display 10 includes one or more shelves or trays 18. Front 12 can be configured in any other suitable way to display and market the desired product. As one of many examples of displaying product, the rear 14 could include a plurality of peg holes to receive trays, shelves, or hooks. The display 10 can be configured according to a planogram if desired.

Figure 3:
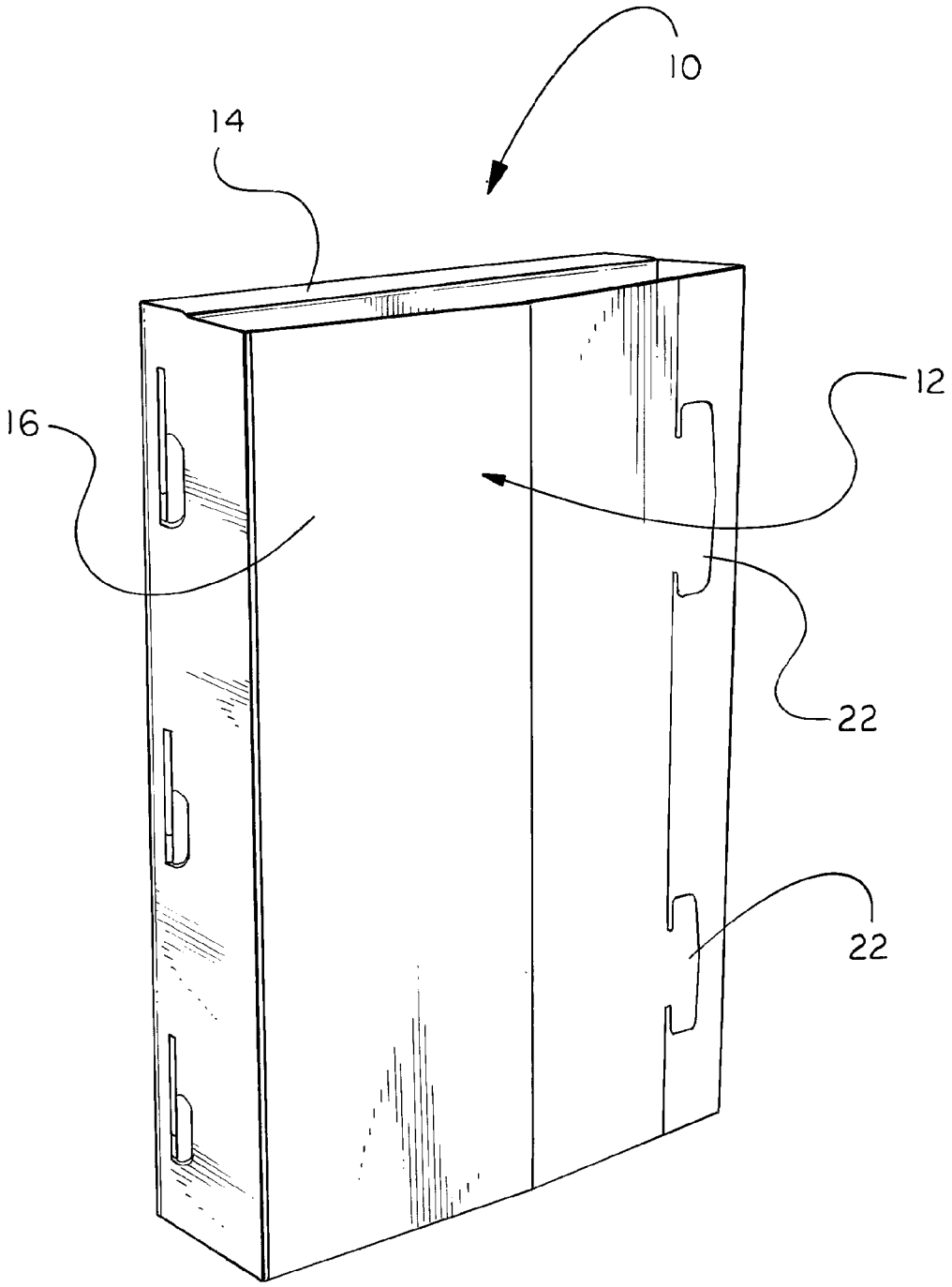
FIG. 3 is a front perspective view of the end cap display of FIG. 2, shown in a shipping position.

Display 10 is movable between a shipping position (FIG. 3) and the display position (FIGS. 1-2 and 12). As shown in FIG. 3, when the display 10 is in the shipping position, the side wings 16 rotate about their fold lines 26 and 28 (FIG.

4) to cover the front 12 of the display. Such an arrangement helps protect the front 12 of the display during shipment while maintaining the display in a relatively flat configuration for shipping.

Figure 4:
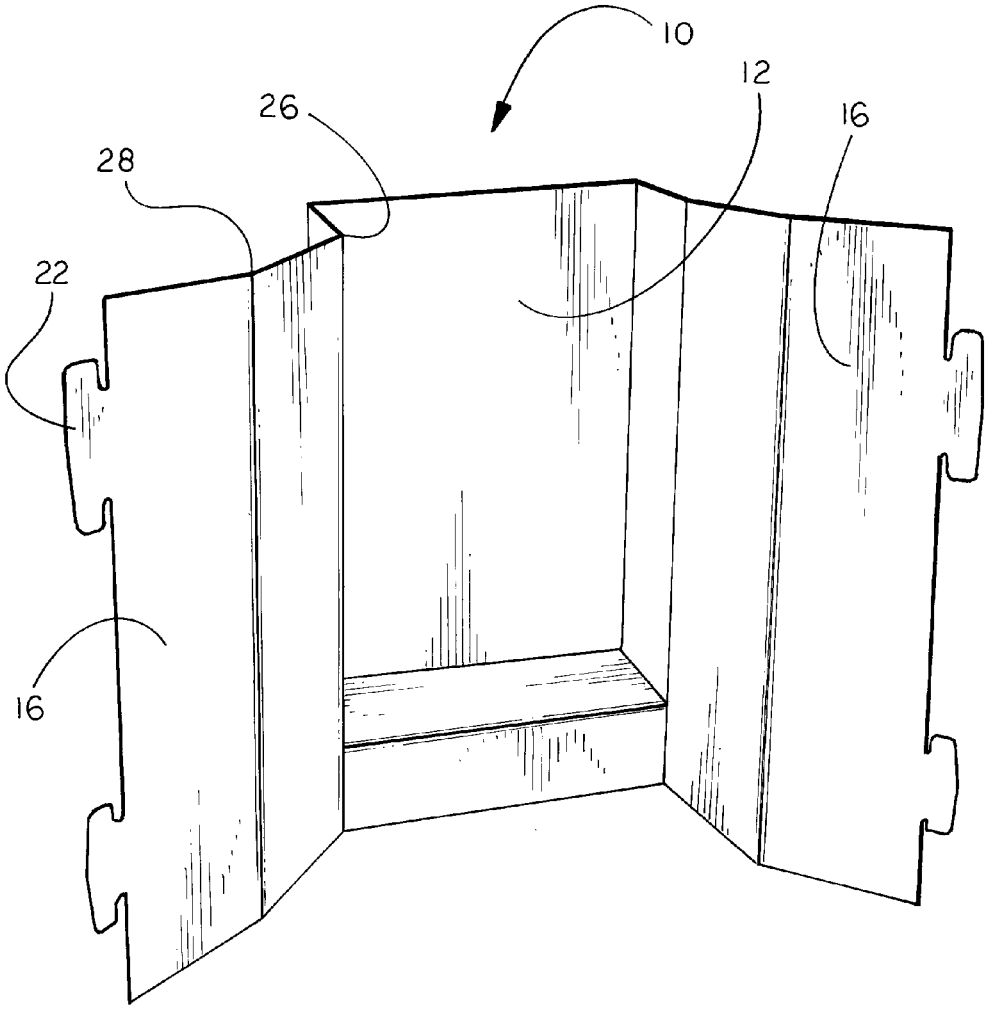
FIG. 4 is a front perspective view of the end cap display of FIG. 2, shown as the display is converted from its shipping position toward a display position.
Figure 5:
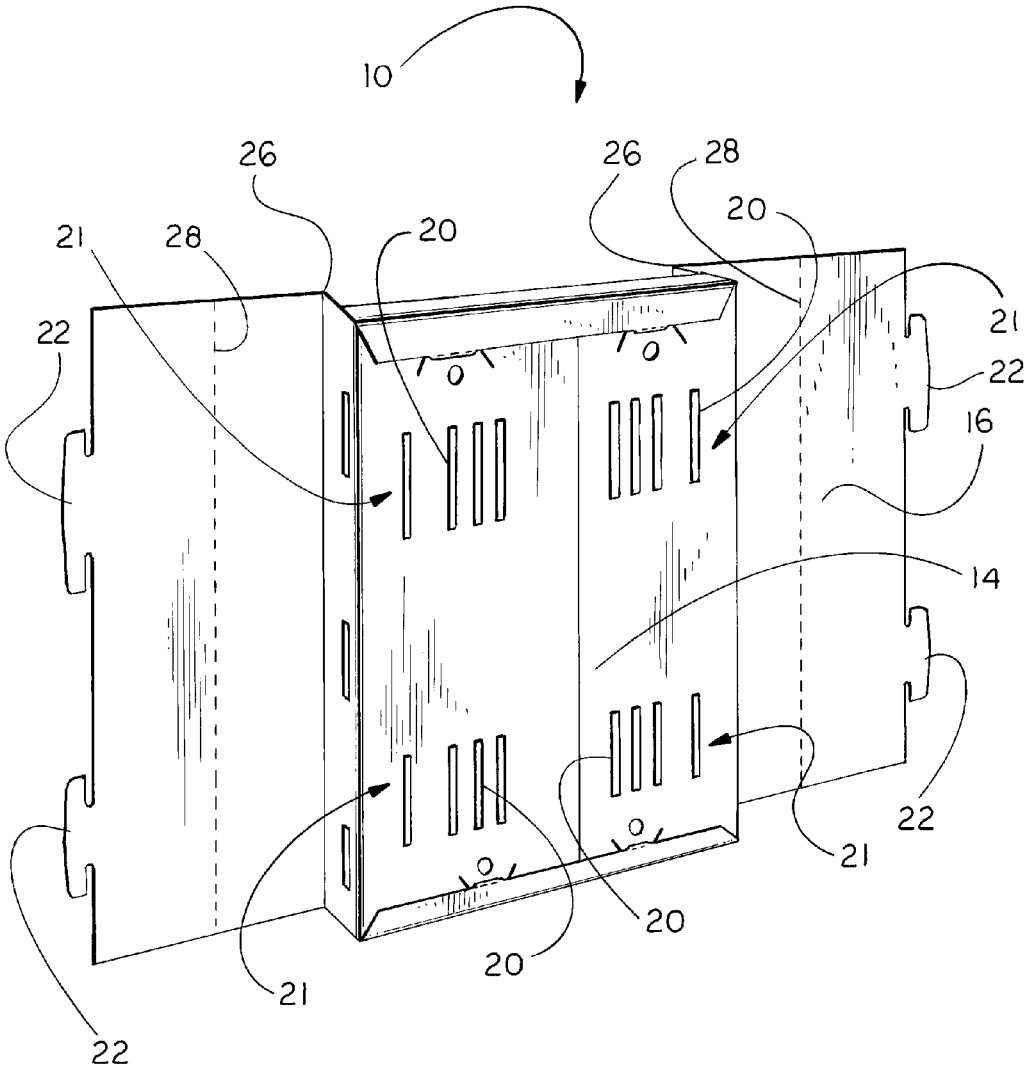
FIG. 5 is a rear perspective view of the end cap display of FIG. 2, shown as the display is converted toward its display position.
Figure 6:
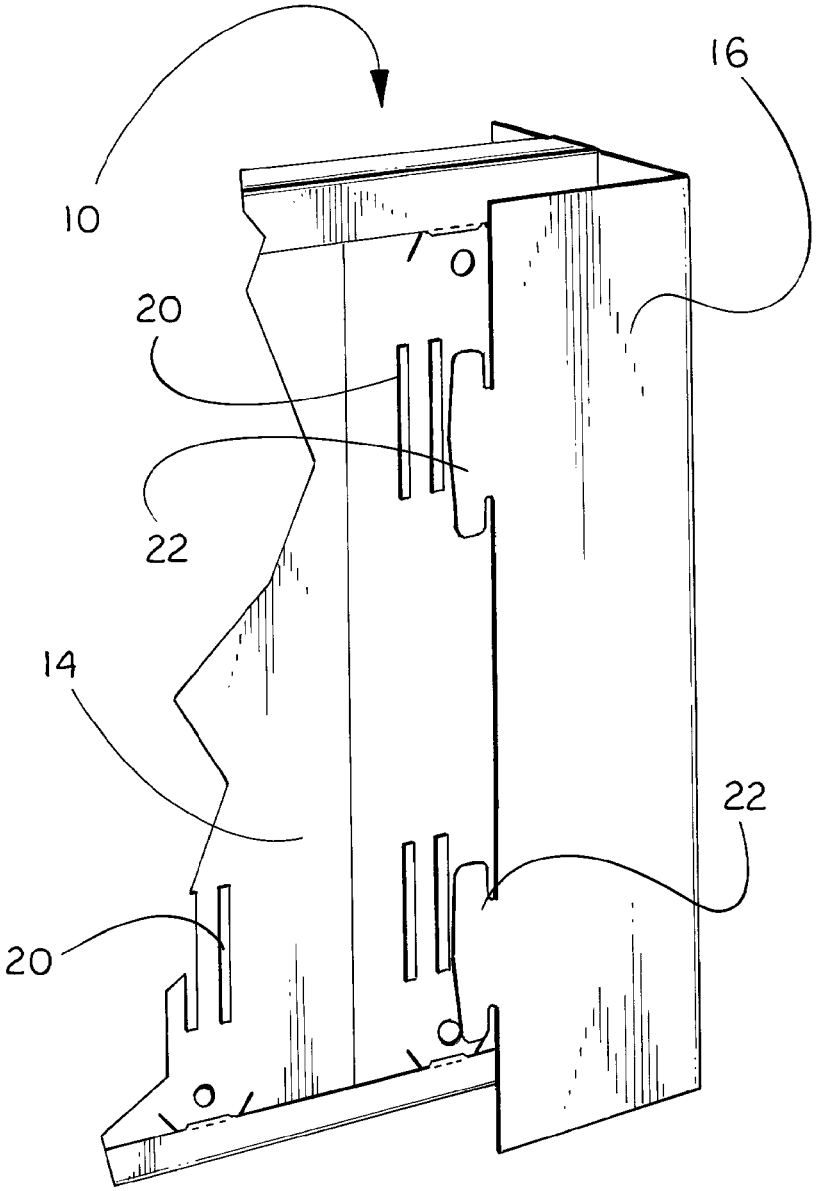
FIG. 6 is a rear perspective view of the end cap display of FIG. 2, shown as the display is converted into its display position.
Figure 7:
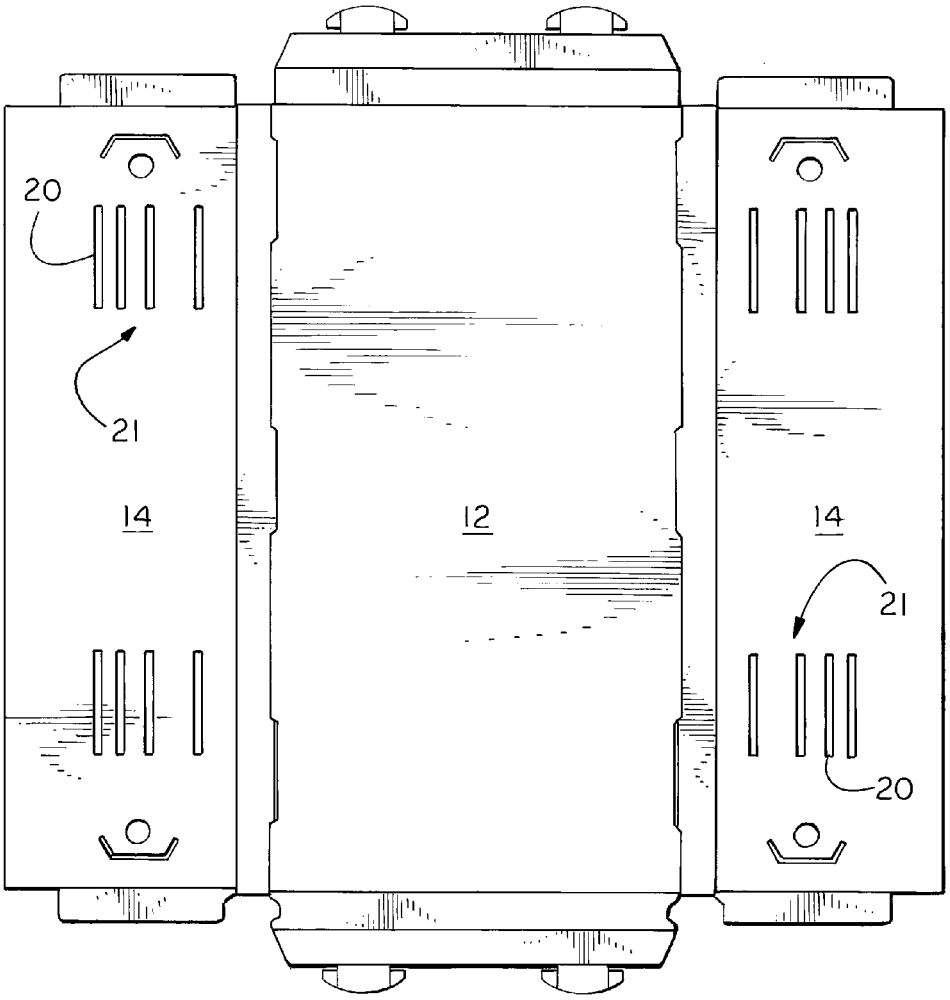
FIG. 7 is a blank from which the rear panel of the display of FIG. 2 is erected.
Figure 8:
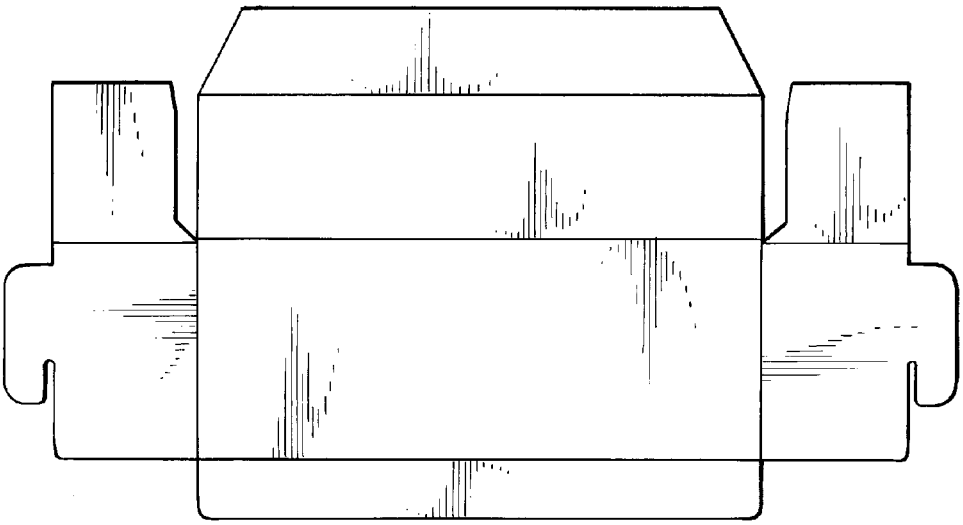
FIG. 8 is a blank from which the base of the display of FIG. 2 is erected.
Figure 9:
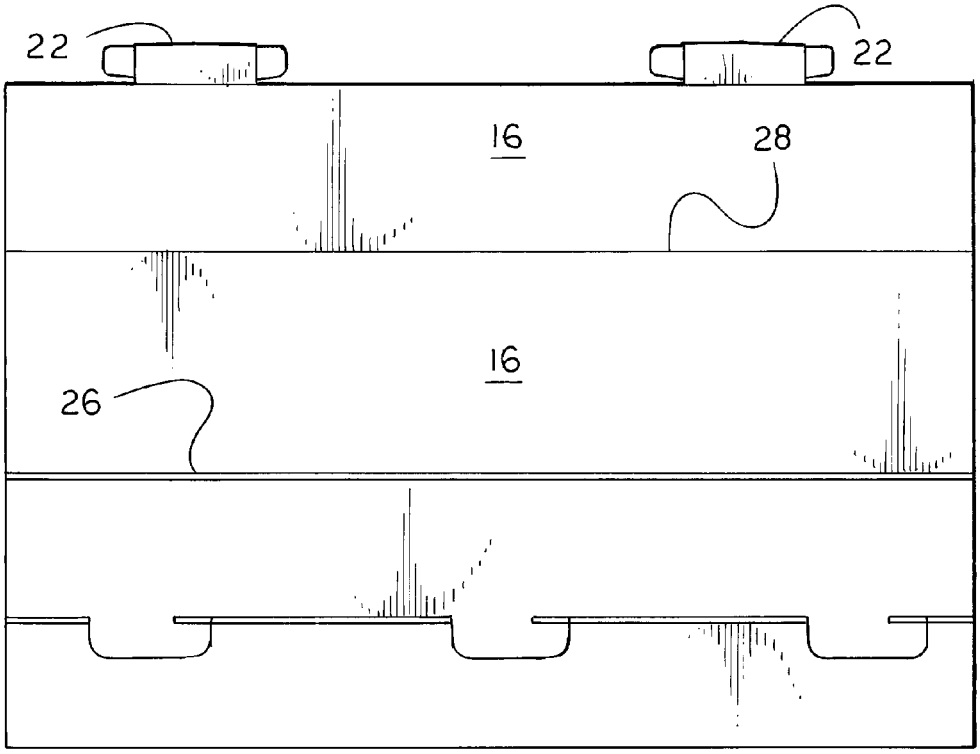
FIG. 9 is a blank from which one of the side wings of the display of FIG. 2 is erected.
Figure 10:
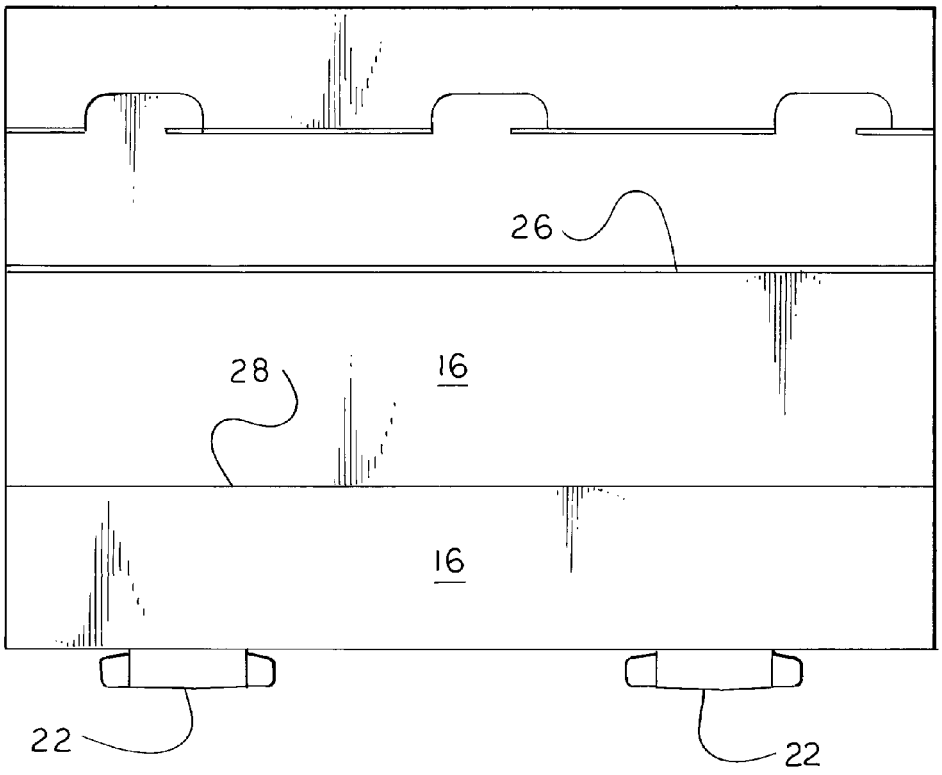
FIG. 10 is a blank from which one of the side wings of the display of FIG. 2 is erected.

FIGS. 4-6 illustrate the display 10 as it moves from the shipping position into the display position. As shown in FIGS. 4-5, the side wings 16 unfold from the front 12 of the display and pivot around fold lines 26 and 28 toward the rear 14 of the display 10. The positioning of the portions of side wings 16 about their fold lines 26 and 28 alters the width $W_S$ of side wings 16 (FIG. 2). The rear 14 of the display includes a plurality of series 21 of slots 20. The slots 20 ultimately determine the width of the display 10 when in its display position. In other words, the width $W_D$ of the assembled display 10 (FIGS. 2 and 12) can be adjusted depending on which slot 20 of each series 21 of slots is selected. In one embodiment, each of the slots 20 is positioned along the rear 14 so that the width of the assembled display 10 is variable to interface with end caps having widths of approximately 24", 26" 30", and 36", or any other sized end cap. However, display 10 can be configured so its width is adjustable between any desired ranges, including, but not limited to, between approximately 24" and 48" and all increments in between.

In the illustrated embodiment, rear 14 includes four series 21 of slots 20, although any suitable number of series 21 of slots can be used. In the illustrated embodiment, two of the four series 21 of slots are arranged along an upper portion of the rear 14 and the other two of the four series 21 of slots are arranged along a lower portion of the rear 14. In the illustrated embodiment, each series 21 of slots includes four slots 20, arranged so that the assembled display accommodates end caps of a desired width, although each series 21 can include any suitable number of slots 20. As one non-limiting example, each series 21 of slots 20 is arranged to accommodate end caps with a width of approximately 24", 26", 30", and 36".

More particularly, after the side wings 16 pivot toward the rear 14 about fold lines 26 and 28, each tab 22 can be positioned within the desired slot 20 of one of the series 21 of slots. Positioning the tabs 22 in the selected slots 20 affects how the side wings 16 are folded along fold lines 26 and 28 and thus alters the width $W_S$ of side wings 16 (FIGS. 2 and 12), which adjusts the overall width $W_D$ of the display 10. Tabs 22 are configured in any suitable way such that they can be lockably received within each of the slots 20. In the illustrated embodiment, each side wing 16 includes two tabs 22, with an upper tab 22 cooperating with one slot 20 of one of the upper series 21 of slots and a lower tab 22 cooperating with a slot 20 of one of the lower series 21 of slots. Any suitable mechanism for providing an adjustable width for the display may be used. As a few of many non-limiting examples, the display may include a series of holes for receiving a clip, protrusion, tab, or any other suitable mechanism. The rear may include the series of apertures and the wings may include the clips, protrusions, tabs, etc., or vice versa.

In some embodiments, a riser 24 (FIGS. 1-2) can lock with or otherwise be positioned with respect to the side wings 16 to follow the desired width contour and bring the end cap display 10 to a desired height.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A width adjustable end cap display for displaying products, movable between a shipping position and a display position, wherein the adjustable end cap display comprises: a central panel having a rear and a front opposite the rear, the central panel comprising a plurality of series of apertures, wherein each of the plurality of series of apertures comprises at least two apertures that are horizontally spaced apart, the least two apertures each comprising a longitudinal axis, each longitudinal axis of the at least two apertures being parallel to each other; and two side wings, wherein each of the two side wings extends from an end of the central panel and wherein each of the two side wings comprises at least one tab; wherein, when in the shipping position, the two side wings fold over the front so as to cover and protect a substantial portion of the front, and wherein, when in the display position, the two side wings fold toward the rear and the at least one tab of each of the two side wings is lockably received within one of the at least two apertures; and wherein the at least two apertures of each of the plurality of series of apertures are positioned so that a width of the display in the display position is adjustable by moving the at least one tab from a first of the at least two apertures to a second of the at least two apertures.

2. The adjustable end cap display of claim 1, wherein each of the plurality of series of apertures comprises at least three apertures.

3. The adjustable end cap display of claim 1, wherein each of the plurality of series of apertures comprises at least four apertures.

4. The adjustable end cap display of claim 1, wherein the plurality of series of apertures comprises four series of apertures.

5. The adjustable end cap display of claim 1, wherein each of the two side wings comprises at least two tabs, wherein a first of the at least two tabs is positioned on an upper portion of each of the side wings and a second of the at least two tabs is positioned on a lower portion of each of the side wings.

6. The adjustable end cap display of claim 1, further comprising a riser that cooperates with the two side wings and extends upwardly from each of the two side wings.

7. The adjustable end cap display of claim 3, wherein the at least four apertures are positioned along the rear so that the width of the display can be adjusted between approximately 24 inches, approximately 26 inches, approximately 30 inches, and approximately 36 inches.

8. The adjustable end cap display of claim 1, wherein each of the two side wings comprises at least one fold line.

9. The adjustable end cap display of claim 8, wherein positioning the at least one tab of a corresponding one of the two side wings in the one of the at least two apertures rotates a portion of the corresponding side wing about the at least one fold line to determine a width of the corresponding side wing.

10. The adjustable end cap display of claim 9, wherein the width of the adjustable end cap display is adjusted by adjusting the width of each of the two side wings.

11. The adjustable end cap display of claim 1, wherein the at least two apertures comprise at least two slots.

12. A width adjustable end cap display for displaying products, movable between a shipping position and a display position, wherein the adjustable end cap display comprises: a central panel having a rear and a front opposite the rear, the central panel comprising a plurality of series of apertures, wherein each of the plurality of series of apertures comprises at least two apertures that are horizontally spaced apart, the least two apertures each comprising a longitudinal axis, each longitudinal axis of the at least two apertures being parallel to each other; and two side wings, wherein each of the two side wings extends from an end of the central panel and wherein each of the two side wings comprises at least one tab; wherein, when in the shipping position, the two side wings fold over the front so as to cover and protect a substantial portion of the front, and wherein, when in the display position, the two side wings fold toward the rear and the at least one tab of each of the two side wings is lockably received within one of the at least two apertures; and wherein the at least two apertures of each of the plurality of series of apertures are positioned so that a width of the display in the display position is adjustable by at least two inches by moving the at least one tab from a first of the at least two apertures to a second of the at least two apertures.

13. The adjustable end cap display of claim 12, wherein each of the plurality of series of apertures comprises at least three apertures.

14. The adjustable end cap display of claim 12, wherein each of the plurality of series of apertures comprises at least four apertures.

15. The adjustable end cap display of claim 12, wherein the plurality of series of apertures comprises four series of apertures.

16. The adjustable end cap display of claim 12, wherein each of the two side wings comprises at least two tabs, wherein a first of the at least two tabs is positioned on an upper portion of each of the side wings and a second of the at least two tabs is positioned on a lower portion of each of the side wings.

17. The adjustable end cap display of claim 12, further comprising a riser that cooperates with the two side wings and extends upwardly from each of the two side wings.

18. The adjustable end cap display of claim 15, wherein the at least four apertures are positioned along the rear so that the width of the display can be adjusted between approximately 24 inches, approximately 26 inches, approximately 30 inches, and approximately 36 inches.

* * * * *